US007311346B2

(12) United States Patent
Bakke

(10) Patent No.: US 7,311,346 B2
(45) Date of Patent: Dec. 25, 2007

(54) ARRANGEMENT IN A GRIPPER MECHANISM FOR A FREE PIPE/RODLIKE END PORTION OF A DOWNHOLE TOOL

(75) Inventor: Stig Bakke, Algard (NO)

(73) Assignee: Bakke Technology AS, Algard (NO)

( * ) Notice: Subject to any disclaimer, the term of this patent is extended or adjusted under 35 U.S.C. 154(b) by 1 day.

(21) Appl. No.: 10/506,128

(22) PCT Filed: Sep. 26, 2001

(86) PCT No.: PCT/NO01/00392

§ 371 (c)(1),
(2), (4) Date: Jul. 1, 2005

(87) PCT Pub. No.: WO03/027434

PCT Pub. Date: Apr. 3, 2003

(65) Prior Publication Data

US 2006/0001283 A1 Jan. 5, 2006

(51) Int. Cl.
*E21B 31/18* (2006.01)

(52) U.S. Cl. ..... 294/86.3; 294/102.2

(58) Field of Classification Search ..... 294/86.3, 294/86.25, 86.31, 102.1, 102.2
See application file for complete search history.

(56) References Cited

U.S. PATENT DOCUMENTS 2,128,430 A 8/1938 Pryor (Continued)

FOREIGN PATENT DOCUMENTS

GB 2 184 760 7/1987

(Continued)

OTHER PUBLICATIONS

NO Search Report dated Oct. 4, 2000 from NO Application No. 2000 1721.

(Continued)

*Primary Examiner*—Dean J Kramer
(74) *Attorney, Agent, or Firm*—Patterson & Sheridan, LLP

(57) ABSTRACT

A gripper mechanism (22) suspended in a coiled tubing/wireline in a well serves to releasably hold a downhole tool or other piece of equipment positioned downstream, via a tubular connecting element (10). The gripper mechanism (12) comprises axially, two relative to each other, movable coaxial parts (18, 16), a gripping part (18) designed to grip said connecting element (10) and an actuating part (16) designed to exert a radial clamping effect on the gripping portion (18*a*) of the gripping part (18) when this is in engagement with said connecting element (10). The clamping effect is due to complimentary conical face on opposite sides of the two parts (16, 18) of the gripper mechanism (12) being forced against each other by the axial displacement of one part (16) relative to the other part (18) in one direction (the upstream/pull-up direction). In order to enable a small cone/coning angle to be used at these complimentary conical faces, while at the same time ensuring that the conical faces do not get wedged to each other across a longitudinal course in the axial direction, the conical faces of each part (18 and 16) have been divided, so that each conical face comprises annular conical part faces (32, 28) and intermediate annular cylindrical part faces (34, 30). The conical part faces (32, 28) have a mutually equal amount of taper and the same axial extent. The intermediate cylindrical part faces (34, 30) have a mutually equal axial extent.

7 Claims, 5 Drawing Sheets

U.S. PATENT DOCUMENTS 2,553,985 A 5/1951 Siracusa
4,124,245 A * 11/1978 Kuenzel ..... 294/86.3
5,054,833 A * 10/1991 Bishop et al. ..... 294/86.3

FOREIGN PATENT DOCUMENTS

GB 2 185 279 7/1987
NO 2000 1721 10/2001

OTHER PUBLICATIONS

PCT International Preliminary Examination Report dated Dec. 15, 2003 based on PCT/NO01/00392.
PCT International Search Report dated Apr. 30, 2002 based on PCT/NO01/00392.

* cited by examiner

ARRANGEMENT IN A GRIPPER MECHANISM FOR A FREE PIPE/RODLIKE END PORTION OF A DOWNHOLE TOOL

This invention regards an arrangement at a gripper mechanism of the type designed to grip and hold a device in the form of a free pipe/rodlike element, often in the form of an end portion forming part of a downhole tool or a so called "fish", where the gripper mechanism comprises two axially, relative to each other, movable parts, a gripping part for gripping said end portion on the outside, or—in the case of a tubular end portion—inside same, and an actuating part for securing this engagement by clamping the gripping portion of the gripping part around the outside/against the inside of said end portion, by mutually complementary conical faces of the gripping and actuating parts being brought to engagement while the gripping portion of the gripping part is in engagement with said pipe/rodlike end portion.

Said downhole tool will in these cases be located downstream of the gripping mechanism, with reference to the direction of lowering into the well, and will include said free end portion as its upstream part or respectively its upstream connecting link to the intended releasable gripper mechanism.

Throughout this description and the appended claims, the terms upstream/downstream refer to the direction of lowering of the arrangement.

In the case of such downhole tools, the lowering/pull-up operations are normally carried out by use of a wire/cable, a so-called wireline or coiled tubing.

The clamping effect that is established and maintained by the co-operating, complementary conical faces on the opposite side of the gripping part relative to the face of the gripping portion, which engages the opposite (outside or inside) surface of said end portion, and on that side of the actuating part which in the clamping position faces said opposite side, through the pressure action of directly abutting surfaces, is effected by a relative, axially directed displacement between the gripping part and the actuating part. Normally, the direction of tightening for the actuating part will coincide with the pull-up direction.

By such downhole tools and other similar types of equipment used in downhole operations, it is not uncommon for the tool/equipment or parts of this to wedge in and get stuck in the downhole position in the well.

Thereby the gripping part of the gripper mechanism will also be stuck as long as it is associated with said free rod-shaped/tubular end portion.

In order to ensure reliable holding of the gripping part on the outside/inside of the free pipe end portion under normal conditions, the engagement surface of the gripping portion is commonly provided with small, friction seeking gripping teeth, points, sawtooth-like projections etc., which by the radially directed clamping force of the actuating part are forced to bite slightly into the opposite face of/in the free pipe end portion—an engagement that should be releasable upon the actuating part being lowered, thus being brought out of the clamping condition; in particular if the conditions have been arranged so that the gripping part may then be pulled upwards through a direct operation.

The actuating part may however have become so wedged into the gripping part in the area of the co-operating complementary conical faces that it does not come loose when the wire/coiled tubing is lowered.

In the case of a freeing attempt that involves the gripper mechanism then being pulled upwards in the pull-up direction, the conical clamping face of the actuating part is brought into even more powerful, wedging abutment against the complementary conical face of the gripping part, and the more/harder said wireline or coiled tubing is pulled, the tighter and more inseparable the connection between the free tubular end portion, gripping part and actuating part becomes.

Such a situation, in which one attempts to tear the gripper mechanism loose from the stuck, free pipe end portion, is uncontrollable, and the wire/coiled tubing may easily be torn off at any location along the length of the wire/coiled tubing, separating it e.g. near the surface or halfway along its length.

It is possible to reduce or even eliminate the locking effect that occurs at the mutually complementary, co-operating conical faces by using a relatively large cone/coning angle. However this presupposes a corresponding increase in the diameter of the location in question. This is not very desirable, considering the space restrictions that normally apply.

A small cone/coning angle is synonymous with conical faces having a corresponding great axial length. However, there is normally plenty of space in the longitudinal direction for all applications relevant to the present invention. The disadvantage of a small cone/coning angle at co-operating conical faces in the case of axially movable parts of the type in question, is the danger of deadlocking between the gripping, abutting cone faces.

In order to avoid compression/deformation of the stuck pipe end portion when the pipe is thin-walled, it is desirable to use conical faces with a great axial length.

The object of the invention has been to ensure termination of an established clamping engagement between said complementary faces by adaptation of a small cone/coning angle, so that the diameter of the equipment need not be increased in the relevant longitudinal area for co-operating cone faces, while at the same time ensuring secure holding when the gripping part, through use of the actuating part, is to be clamped onto/into the free pipe end portion connected to said downstream downhole tool. It is also an object of the invention to establish secure holding of the free pipe end portion without deforming this.

According to the invention, the object is realised by shaping said co-operating, complementary conical faces on the axially, relative to each other, movable gripping part and actuating part of said gripper mechanism in the manner stated in the characterising part of the appended claims.

According to the invention, said clamping face on the actuating part is formed by alternately positioned annular faces occurring in the axial extension of each other, against each other and formed with conical and cylindrical courses respectively, every other annular face defining a conical shape with a mutually equal amount of taper, while the intermediate annular faces are approximately cylindrical, with annular, alternately conical and cylindrical faces that are essentially complementary to the annular faces of the actuating part, being provided on the gripping part.

The axial extent of each of said annular conical portions may in one embodiment be approximately the same, while each of the annular circular cylindrical portions are approximately equivalent to each other.

Each of the circular cylindrical annular faces may have a greater axial extent than the intermediate conical annular faces, as the general aim is to keep the cone/coning angle small and the same from annular conical face to annular conical face, the equal amount of taper (cone angle) of the annular conical faces being slightly greater than that of a long, continuous conical face covering the entire axial longitudinal extent that according to the present invention is covered by the alternating conical/cylindrical longitudinal portions of the gripping part/actuating part.

In an axial longitudinal section, the diagonal lines defining the annular conical faces will be displaced in parallel to each other (at an increasing distance from each other in the upstream direction/pull-up direction). The same holds for the axially parallel lines defining the intermediate annular, circular cylindrical faces.

Based on the alternating annular portions of one part (e.g. the actuating part), the other part has annular faces shaped so as to essentially complement these.

By such shaping of the interacting complementary conical clamping faces on the gripping part and the actuating part, each conical annular "part face" may be given a relatively short axial length, e.g. of the order of magnitude adapted to in the case of corresponding unbroken conical faces at a large cone/coning angle. The long axial reach of unbroken conical faces with a small cone/coning angle is according to the invention "divided up" at the intermediate circular cylindrical portions. By an arrangement in accordance with the invention, satisfactory clamping around said pipe/rod-shaped end portion, respectively inside an equivalent tubular end portion, normally associated with a downstream downhole tool/piece of equipment is achieved, while also allowing ready disengagement of said clamping in a situation in which it is desirable to release and separate said gripper mechanism from the pipe end portion. This favourable effect is brought about by the withdrawal/pulling-out distance between complementary clamping portions at a small cone angle—in the release situation—being limited to a freeing distance that falls short of the axial length of one conical annular portion, while at the same time, there are—in the clamping situation—more than one co-operating pair of conical clamping faces, distributed in the axial direction with intermediate circular cylindrical annular portions, and which clampingly abut each other along part of their axial extent.

A non-limiting example of an embodiment of the invention is explained in greater detail in the following, with reference to the accompanying drawings, in which.

Figure 2:
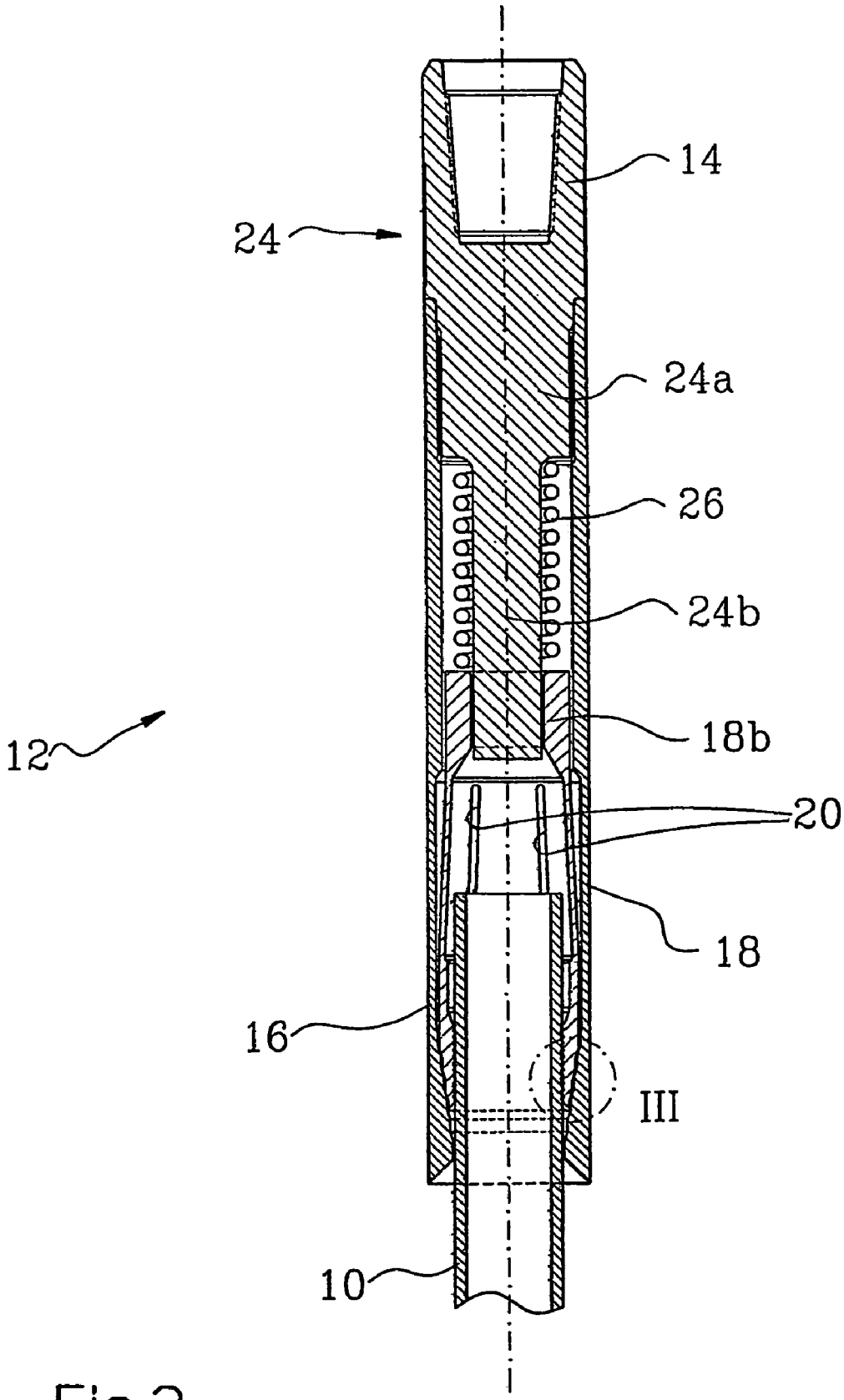
FIG. 2 is similar to FIG. 1, but here the gripper mechanism has been brought into enclosing, clamped engagement with the pipe end portion, which engagement may be terminated by lowering the actuating part in the form of a radially outer sleeve that is arranged to be axially movable relative to the internally positioned gripping part.
Figure 4:
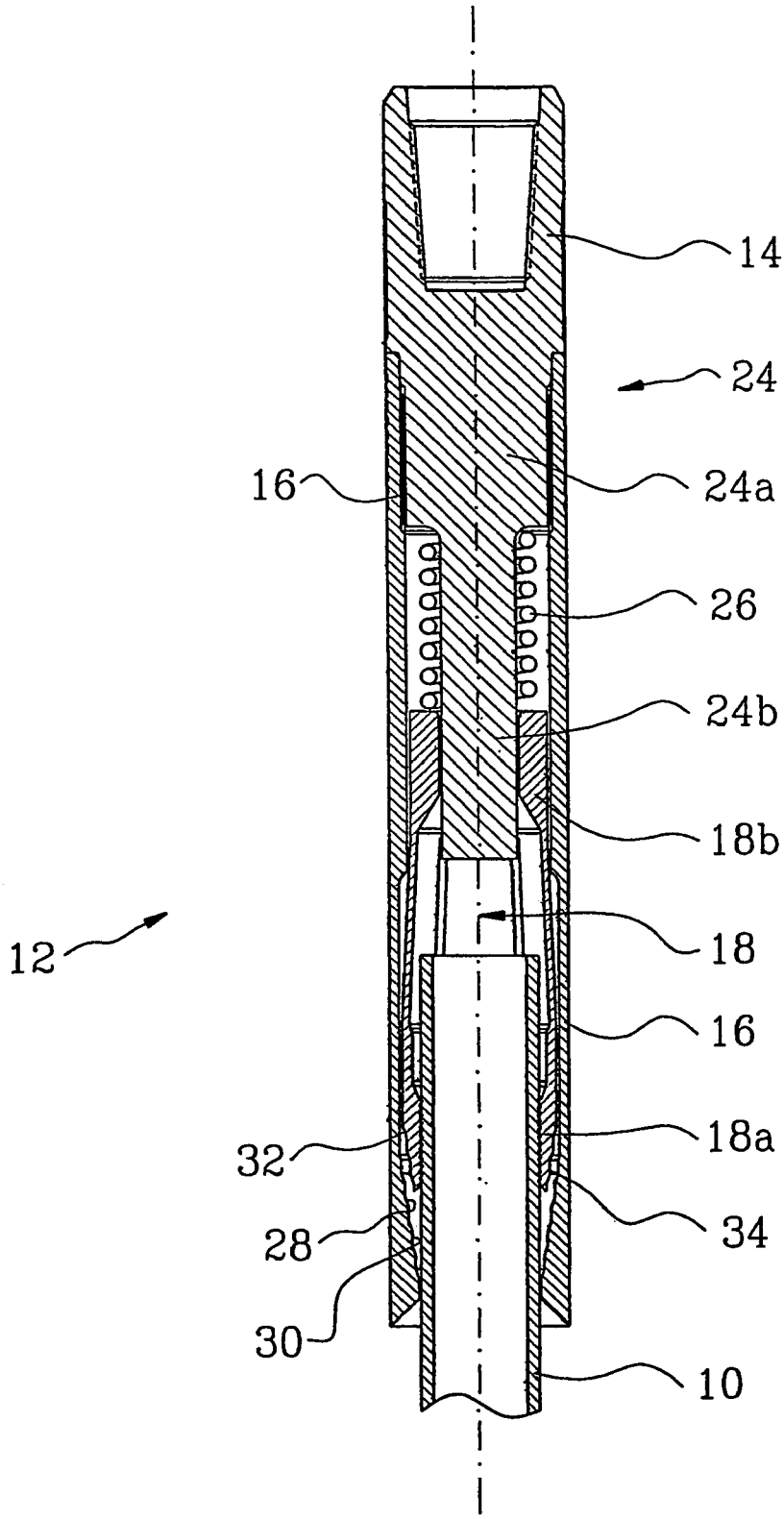
Figure 5:
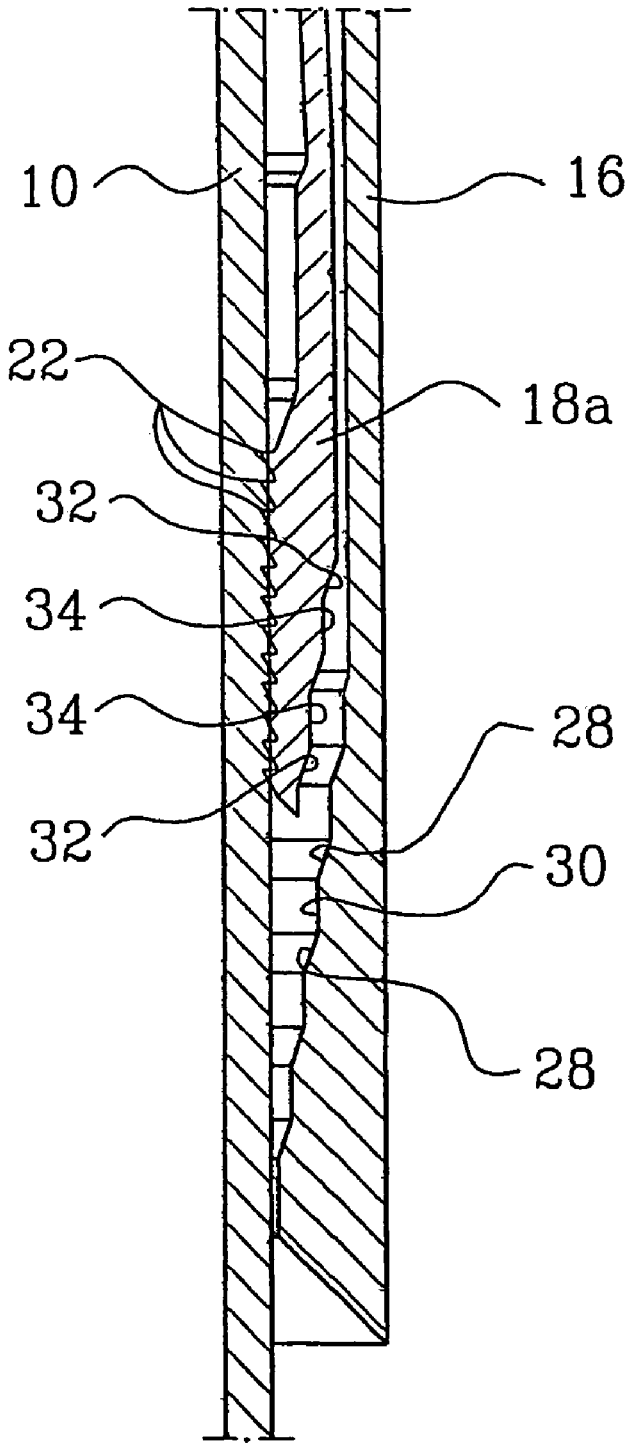

FIG. 4 is similar to FIG. 2, but shows the gripper mechanism in a release position in which its radially outer actuating part is lowered relative to the gripping portion/fingers of the gripping part, in order to end the clamping effect on the gripping fingers, whereby the gripper mechanism as a whole may be pulled up; and FIG. 5 shows a cut-out from FIG. 4, and shows that the clamping engagement between the gripping part and the actuating part has ended, by the axial displacement of the latter in the downstream direction, whereby the special clamping faces of the parts, which are provided with complementary, conical shapes, are no longer adjacent and co-operating.

A gripper mechanism shown in the drawings is formed and designed especially for gripping and releasable holding of a device/element/part/portion in the form of a freely ending pipe/rodlike element 10, which in practical embodiments may be associated with a downstream downhole tool/piece of equipment (not shown) in a well.

When releasing, FIGS. 4 and 5, it is presupposed that the pipe end portion 10 or another part connected to this has wedged in and become stuck in the downhole position in the well, and that the aim of the release of the gripper mechanism shown and described has primarily been to reacquire the wireline/coiled tubing intact, with the purpose of then having initiated a successful start operation in order to subsequently correct the situation that has occurred.

The gripper mechanism 12 and the pipe end portion 10 have been shown in a common, e.g. vertical position of use, and it is reiterated that the term upstream/downstream everywhere refers to the direction of lowering of the gripper mechanism 12.

At the upstream end, the gripper mechanism 12 is provided with a fastener 14 for fastening of a wireline, possibly with an attached percussion mechanism that is known per se (not shown) or screwing in of the outer end of coiled tubing not shown).

Figure 3:
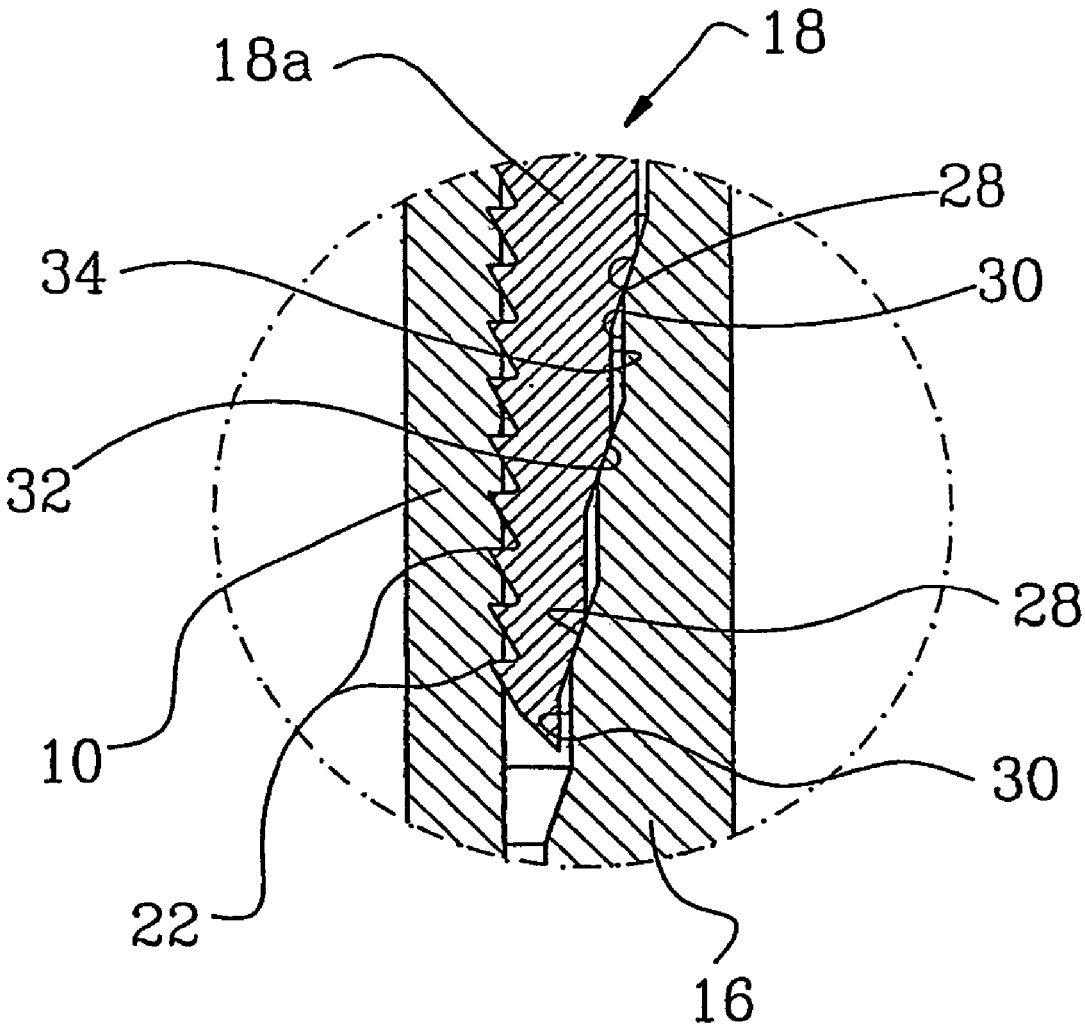
FIG. 3 is s cut-out III of FIG. 2, on a considerably larger scale than FIGS. 1 and 2.

The radially outer sleevelike/tubular actuating part 16 of the gripper mechanism 12 serves to clamp the fingers 18*a* of the gripping part 18, which fingers are defined between longitudinal slits 20 and which in the gripping portion are formed with oblique barb-like gripping teeth 22 or similar projecting means for biting into the surface layer of the material of the facing pipe end portion, see FIG. 3.

The fastener 14 is formed at the upstream end of an internal longitudinal part 24 of the gripper mechanism 12, which at an annular portion 24*a* immediately downstream of the fastener 14 is screwed to the pipe/sleeve-shaped actuating part 16, and which downstream of the annular threaded portion 24*a* has a central straight part 24*b* with a reduced diameter, the downstream portion of which part projects into an upper annular part 18*b* of the gripping part 18.

Around the straight part 24*b* is arranged a compression spring 26 in the form of a helical spring, the upstream end of which is in supporting abutment, partly against the downstream facing annular surface at the transition between the portions 24*a*, 24*b* of the part having different width, and partly against the upstream facing annular end face of the annular part 18*b* of the gripping part 18 which is not split in the longitudinal direction, but serves as a connecting means for longitudinal, slightly resilient gripping fingers 18*a*.

Figure 1:
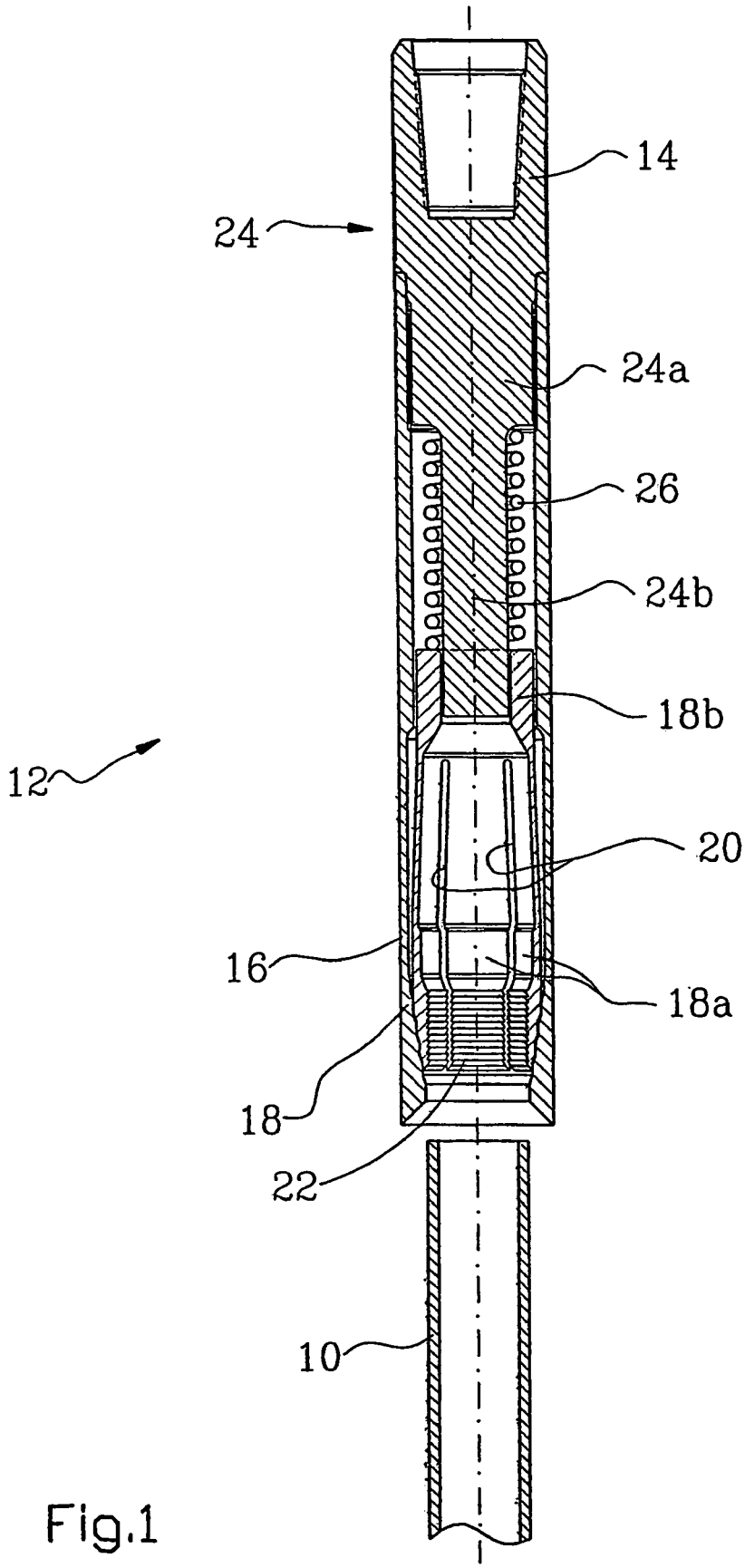
FIG. 1 is an axial longitudinal section showing a gripper mechanism in an initial position immediately before being lowered down (or immediately after the gripper mechanism has been brought out of engagement with the pipe end portion) and brought to grip and clamp around the free end portion of a tubular element thought to form e.g. a part of a downstream downhole tool (not shown)

In FIG. 1, the downstream free end portions of gripping part 18 and actuating part 16 are shown in a relative axial position in which the gripping fingers 18*a* are spread slightly more out in the radial direction than in the locked position of FIG. 2, so that the gripping part 18 with the enclosing actuating part 16 may be lowered onto the outside of the pipe end portion 10 and grip this. (In another embodiment, the gripping part may be lowered into the free pipe end portion 10, the actuating part then being placed inside the gripping part and with axial mobility relative to this).

On the mutually opposite, upon relative axial displacement clampingly engaging clamping faces—here on the outside of the gripping fingers 18*a* and the inside of the actuating part 16—mutually complementary, in one direction tapering portions have been formed in a manner that is known per se. The purpose of these co-operating conical faces on the gripping part and the actuating part is to force the gripping teeth 22 of the gripping part 18 into the pipe end portion (see FIG. 3) when the actuating part 16 is pulled up in the upstream/pull-up direction, whereby the relative positions of FIGS. 2 and 3 result.

In accordance with the present invention, the complementary clamping faces of the gripping and actuating parts have a very particular arrangement and positioning:

On the clamping face of the actuating part 16 are formed several annular conical faces 28 placed in the axial extension of each other, with intermediate circular cylindrical annular faces 30. Preferably, the annular conical faces 28 have the same cone/coning angle (e.g. 10-30°) and the same linear dimension. The intermediate circular cylindrical faces 30 will normally have equal axial linear dimensions, preferably slightly larger than each of the annular conical faces 28. As can be seen clearly from FIG. 3, the abutment surfaces 28, 32 of the opposing, by pairs co-operating conical faces have an axial linear dimension that is less than the axial linear dimension of each annular face 30, 34.

In the area of the free downstream portion of the gripping fingers 18*a*, the gripping portion of the gripping part 18 has a shape that is complementary to the conical shape 28, 30 of the actuating part 16 and comprises annular faces, i.e. alternating conical and circular cylindrical faces, 32 and 34 respectively.

By lowering the actuating part 16 from the FIG. 2 position to the FIG. 4 position, the radially directed clamping forces that act on the engagement between the gripping part 18 and the stuck pipe end portion 10, are removed.

Using only a smooth, longitudinal cone on the actuating part and the gripping part, as in prior art, will generally make it difficult to terminate the engagement between the actuating part and the gripping part.

The invention claimed is:

1. A gripping arrangement for selectively gripping a pipe, the arrangement comprising:

a gripping sleeve having a surface comprising a plurality of conical faces separated by cylindrical faces; and an actuating sleeve moveable relative to the gripping sleeve, the actuating sleeve having a corresponding surface comprising a plurality of conical faces separated by cylindrical faces, wherein each cylindrical face has a different diameter along the actuating sleeve and wherein the surface of the gripping sleeve engages with the corresponding surface of the actuation sleeve upon relative axial movement between the actuating sleeve and the gripping sleeve.

2. The gripping arrangement of claim 1, wherein the cylindrical faces have diameters substantially parallel to an axis of the gripping arrangement.

3. The gripping arrangement of claim 1, wherein the conical faces are located at different diameters along the gripping sleeve.

4. The gripping arrangement of claim 1, wherein the conical faces are located at different diameters along the actuating sleeve.

5. The gripping arrangement of claim 1, wherein each sleeve has three or more conical faces, and one cylindrical face is arranged between each two adjacent conical faces.

6. The gripping arrangement of claim 5, wherein each of the sleeve has three, four, or five conical faces.

7. The gripping arrangement of claim 1, wherein a cone angle of each of the conical faces lies in the range 10-30°.

* * * * *